US011857830B2

(12) United States Patent
Stegeman

(10) Patent No.: US 11,857,830 B2
(45) Date of Patent: Jan. 2, 2024

(54) PHYSICAL TRAINING APPARATUS

(71) Applicant: Kynett Holding B.V., Lochem (NL)

(72) Inventor: Gerrit Jan Stegeman, Laren (NL)

(73) Assignee: Kynett Holding B.V., Lochem (NL)

( * ) Notice: Subject to any disclaimer, the term of this patent is extended or adjusted under 35 U.S.C. 154(b) by 299 days.

(21) Appl. No.: 17/293,512

(22) PCT Filed: Nov. 11, 2019

(86) PCT No.: PCT/NL2019/050735

§ 371 (c)(1),
(2) Date: May 13, 2021

(87) PCT Pub. No.: WO2020/101483

PCT Pub. Date: May 22, 2020

(65) Prior Publication Data

US 2021/0402246 A1 Dec. 30, 2021

(30) Foreign Application Priority Data

Nov. 15, 2018 (NL) ..... 2022002

(51) Int. Cl.

| | |
|---|---|
| ***A63B 21/22*** | (2006.01) |
| ***A63B 21/00*** | (2006.01) |
| ***A63B 21/16*** | (2006.01) |

(52) U.S. Cl.

CPC ..... *A63B 21/227* (2013.01); *A63B 21/00061* (2013.01); *A63B 21/153* (2013.01); *A63B 21/16* (2013.01); *A63B 21/4035* (2015.10)

(58) Field of Classification Search

CPC ..... A63B 21/227; A63B 21/00061; A63B 21/153; A63B 21/16; A63B 21/4035; A63B 21/4043; A63B 23/03508

See application file for complete search history.

(56) References Cited

U.S. PATENT DOCUMENTS

| | | | | |
|---|---|---|---|---|
| 518,967 A | | 5/1894 | Poole | |
| 4,625,962 A | * | 12/1986 | Street | A63B 69/06 482/54 |
| 5,180,348 A | * | 1/1993 | Saarinen | A63B 21/153 482/903 |

(Continued)

FOREIGN PATENT DOCUMENTS

| | | |
|---|---|---|
| DE | 9205777 U1 | 7/1992 |
| DE | 10 2011 105 609 A1 | 12/2012 |
| WO | 2018/203311 A1 | 11/2018 |

*Primary Examiner* — Andrew S Lo
(74) *Attorney, Agent, or Firm* — Hoffmann & Baron, LLP

(57) ABSTRACT

A physical training apparatus includes a housing, a flywheel mechanism accommodated in the housing, the flywheel mechanism including a spindle, at least one flywheel mounted on the spindle and bearings to support the spindle in the housing, a windable pull element, such as a pull cord or band, which is arranged to be wound up the spindle and unwound from the spindle, and a handgrip attached to the pull element. The spindle includes a spindle end portion. The flywheel is exchangeably mounted on the spindle end portion against a stop located on the spindle. A fastening knob is releasably coupled to the spindle end portion and adapted to engage the flywheel and force it against the stop located on the spindle.

18 Claims, 9 Drawing Sheets

(56) References Cited

U.S. PATENT DOCUMENTS

| | | | | |
|---|---|---|---|---|
| 7,112,165 | B1 * | 9/2006 | Forsberg | A63B 21/153 482/110 |
| 7,967,728 | B2 * | 6/2011 | Zavadsky | A63F 13/28 482/901 |
| 10,143,880 | B1 * | 12/2018 | Boatwright | A63B 21/078 |
| 10,471,297 | B1 * | 11/2019 | Smith | A63B 24/0087 |
| 2005/0009672 | A1 * | 1/2005 | Yeh | A63B 21/153 482/114 |
| 2009/0036276 | A1 * | 2/2009 | Loach | A63B 21/15 482/72 |
| 2011/0172058 | A1 * | 7/2011 | Deaconu | A63B 24/0087 482/5 |
| 2011/0177923 | A1 * | 7/2011 | Smith | A63B 21/222 482/110 |
| 2016/0339290 | A1 * | 11/2016 | Eisenblaetter | A63B 21/4035 |
| 2019/0201740 | A1 * | 7/2019 | Robert | A63B 21/153 |
| 2019/0247710 | A1 * | 8/2019 | Unsworth | A63B 21/4039 |
| 2020/0023231 | A1 * | 1/2020 | Hsieh | A63B 22/0076 |
| 2021/0244995 | A1 * | 8/2021 | Andrei | A63B 21/0051 |
| 2021/0353994 | A1 * | 11/2021 | Paz Domonte | A63B 21/15 |

* cited by examiner

PHYSICAL TRAINING APPARATUS

CROSS-REFERENCE TO RELATED APPLICATIONS

This application is the National Stage of International Application No. PCT/NL2019/050735, filed Nov. 11, 2019, which claims the benefit of Netherlands Application No. 2022002, filed Nov. 15, 2018, the contents of which is incorporated by reference herein.

FIELD OF THE INVENTION

The present invention relates to a physical training apparatus.

BACKGROUND OF THE INVENTION

DE 9205777 U1 discloses a physical training apparatus of this type. The training apparatus is portable and comprises a closed housing in which a spindle is rotatably mounted by means of bearings. On the spindle two flywheels are mounted in a symmetrical fashion. A pull cord is attached with a first end to the spindle and is wound up the spindle between the two flywheels. The pull cord is guided around a pulley mounted on a handgrip. A second end of the pull cord is attached to the housing.

US 518.967 shows an exercising machine having a housing that is mounted to a block by pivots which allow lateral swiveling of the housing. The block is coupled to a plate which is secured to a rigid support such as a wall, post or floor.

A disadvantage of the physical training apparatus of DE 9205777 U1 is that the exercise load provided by the apparatus cannot be varied.

SUMMARY OF THE INVENTION

It is an object of the invention to provide a physical training apparatus with which more variable exercising loads can be performed.

This object can be achieved by a physical training apparatus according to the present invention, wherein the spindle includes a spindle end portion, wherein the flywheel is exchangeably mounted on the spindle end portion against a stop located on the spindle, and wherein a fastening knob is releasably coupled to the spindle end portion and adapted to engage the flywheel and force it against the stop located on the spindle.

The physical training apparatus according to the invention thus provides the option to easily remove the flywheel from the spindle and to replace it by another flywheel having different dimensions and/or weight. The user can simply release the fastening knob, take the flywheel from the spindle end portion, place another flywheel on the spindle end portion and fasten the assembly by replacing and coupling the fastening knob to the spindle end portion.

Advantageously the bearings are located on the spindle inwardly from the location where the flywheel is mounted on the spindle, i.e. further from the end of the spindle, such that the spindle does not have to be removed from the housing to exchange the flywheel.

In a preferred embodiment of the apparatus according to the invention the fastening knob includes an associated spring element which resiliently forces the flywheel against the stop. The spring element allows that flywheels with different thicknesses can be mounted to the spindle end portion and still be clamped against the stop.

In a particularly preferred embodiment of the apparatus according to the invention the spring element is a multiwave spring. A multiwave spring, which is known per se, advantageously provides a constant clamping force on the flywheel to force it against the stop, independent of the thickness of the flywheel.

Alternatively also other spring elements can be used, which provide a clamping force depending on the deformation of the spring when its mounted against the flywheel. In a possible embodiment the spring elements may be integrally formed on a part of the fastening knob, typically a part of the knob made of a suitable plastic material, such as polyoxymethylene (POM).

In a possible embodiment the spindle end portion has substantially a polygonal cross section, preferably a hexagonal cross section, wherein the flywheel has a central aperture with a corresponding shape which fits over the spindle end portion. The polygonal shape allows to easily couple the flywheel and the spindle in rotational direction. There is always a small play between the edges of the central aperture in the flywheel and the spindle end portion. At the edges of the polygonal shape this may lead to impacts due to the cyclic acceleration and deceleration of the flywheel during normal use. In practice a hexagonal shape sufficiently mitigates the impact of the flywheel on the spindle. If such impacts have to be reduced further, for example for a heavy duty version of the apparatus, a torx shape for the spindle end portion and the central aperture of the flywheel can be considered.

In a possible embodiment of the apparatus according to the invention the fastening knob has an engagement opening, preferably arranged centrally in the knob, wherein said engagement opening is adapted to receive the spindle end portion. This engagement opening thus also preferably has a polygonal shape, but may also have a torx shape.

In a possible embodiment of the physical training apparatus according to the invention a first set of one or more radial projections are formed on the spindle end portion, wherein the central aperture of the flywheel has one or more recesses in its outer contour corresponding with the pattern of the one or more radial projections of the first set such that the flywheel can be moved beyond the one or more radial projections, and wherein the engagement opening of the fastening knob is defined by a radially inwardly extending flange having one or more recesses such that the recesses of the flange can be aligned with the radial projections and when the spindle end portion is inserted in the engagement opening and when the projections are moved beyond the flange, the recesses of the flange can be misaligned with the radial projections of the first set by rotation of the knob relative to the spindle end portion so as to form a bayonet catch wherein the spring element forces the projection(s) of the first set of one or more radial projections into engagement with the flange. A bayonet catch is a convenient coupling type to provide a quick coupling by a consecutive translation and rotation of the fastening knob on the spindle, and a quick release by a rotation and translation of the knob relative to the spindle. It does not require tightening like a screw coupling would, and it provides a univocal positioning of the knob on the spindle end portion. Variations in the thickness of the flywheel are absorbed by the spring element (s).

In a further embodiment of the training apparatus the flange has a rear side having raised formations, wherein in use when the spindle end portion is moved through the receiving aperture of the knob, the first set of projections on the spindle end portion are moved beyond a height of the raised formations and when the recesses are misaligned with said projections, the raised portions are moved beyond the raised formations, such that the raised portions form a retaining stop. The raised formations limit the rotation of the knob with respect to the spindle and thereby prevents alignment of the projections and the recesses. If the knob is pushed inwardly and the spring elements are compressed first, the projections are moved beyond the raised formations, and the knob can be rotated. Then the projections can move through the recesses and the knob can be pulled from the spindle end portion.

In another possible further embodiment the flange has at least one rear surface portion with a pitch, whereby upon rotation of the knob relative to the spindle end portion, at least one of the projections slide relative to the pitched surface and the knob is tightened on the spindle end portion. Preferably the pitched surface has at the end of the rotational stroke a recess into which the projection can snap to retain the knob secured on the spindle end portion. To release the knob the user first has to overcome the resistance of the snap action between the projection and the recess before the knob can be rotated further.

In a possible further embodiment the fastening knob comprises an interior body including the engagement opening and an exterior cap which covers, in a mounted state, the interior body, at least partly, and the spindle end portion. In this embodiment the fastening knob comprises an assembly of an interior annular portion which has the function to couple the fastening knob to the spindle end portion, and an exterior covering cap which has the function to cover the turning spindle end portion and the interior annular portion. The cap is reachable by the user in the mounted state. The spring element(s) may be a separate element, such as a multiwave spring that is assembled with the interior body and/or the exterior cap. However, the spring elements may also be members that are integrally formed on the interior body. The interior body and the exterior part are preferably made of thermoplastic materials by injection moulding. The parts may be made of different thermoplastic materials though.

In a further possible embodiment of the apparatus according the invention, a second set of one or more radial projections are formed on the spindle end portion, wherein the second set of one or more radial projections adjoins the stop, such that when the flywheel is arranged against the stop, the projections of the second set are received in the recesses of the aperture of the flywheel. The second set of projections provides an interlocking between the flywheel and the spindle end portion.

In a possible embodiment of the physical training apparatus according to the invention the housing comprises at least on one lateral side a covering lid, which is removable from the housing to exchange the flywheel. The lid may be connected to the rest of the housing by a pivot structure. The lid shields the flywheel and prevents that persons or objects can touch the flywheel when the apparatus is used and the flywheel may rotate at high speed. In a possible embodiment the covering lid may be transparent, such that the user can see the flywheel through the lid.

In a possible embodiment of the physical training apparatus according to the invention the spindle has two opposite of said spindle end portions and wherein the apparatus comprises two of said flywheels, each one mounted on one of the respective spindle end portions, and furthermore comprises two of said fastening knobs, each one fastening one of the flywheels. In this way a symmetric structure is obtained which reduces torsional loads on the spindle and bearings and other structural parts of the apparatus.

A possible embodiment of the physical training apparatus according to the invention, furthermore comprises a support adapted to be fixed to a stationary structure, such as a pole, a post, a tree, a wall or a door post, wherein the housing is pivotably connected to the support, wherein the pivot axis extends perpendicular to the axis of the spindle. Preferably, the apparatus is mounted such that axis of the spindle extends in a horizontal direction and the pivot axis extends in a vertical direction. Thereby the housing can swivel to some extent to follow a transversal movement of the pull element during a training exercise.

Preferably, the housing is releasably coupled to the support, preferably by a quick release coupling. Thus the housing can be decoupled from the fixed world, so as to carry it to another location. Also for exchanging the flywheel it might be convenient to remove the housing from the fixed support.

In a possible embodiment of the training apparatus according to the invention, the windable pull element has an end which is releasably connected to the spindle. This allows quick replacement of a worn pull element by a new one.

In a preferred embodiment the spindle is made of injection moulded aluminium.

In a basic configuration of the training apparatus of the invention, the spindle has a relatively small diameter, in particular at the wind/unwind portion, compared to other training apparatuses having a flywheel mechanism, which are known from the field. The spindle of the training apparatus according to the invention, at least at the wind/unwind portion, may be in practise be made with a diameter of 10-16 mm. In a preferred embodiment the diameter is 15 mm at the wind/unwind portion. A result of the relatively small diameter of the spindle at the wind/unwind portion of the spindle results in that the moment arm with which the pull element provides the pull force on the spindle is relatively small. Thereby the user has to provide a relatively high force to put and maintain the flywheel mechanism in motion, even if the flywheel of the apparatus according to the invention has an outer diameter of about 250 mm, which is relatively small compared to the other training apparatuses known in the field. This results in a training apparatus that overall is relatively small and is portable. The training apparatus of the invention can thus be carried easily by the user to a desired location, e.g. outdoors, to do a workout, but at the same time allows to do a heavy workout with the same force intensity for the user which is comparable to a workout with heavy non-portable training devices.

Another aspect of the invention comprises a spindle adapter, which includes a reel to be arranged around a wind/unwind portion of the spindle where the windable pull element is wound and unwound during use, wherein the reel has an outer surface on which the windable pull element is wound, and which has an outer diameter which is larger than the diameter of the wind/unwind portion of the spindle. Such an adapter can be used to change the force ratios that are experienced during training exercises with the apparatus. The spindle adapter thus allows to adjust the training apparatus to specific needs or wishes of the user with regard to the force intensity of the workout. This adapter can be seen independent of the apparatus according to the invention and can be sold separately.

BRIEF DESCRIPTION OF THE DRAWINGS

The invention will be further explained in the following description with reference to the drawings, in which.

DETAILED DESCRIPTION OF THE INVENTION

Figure 2:
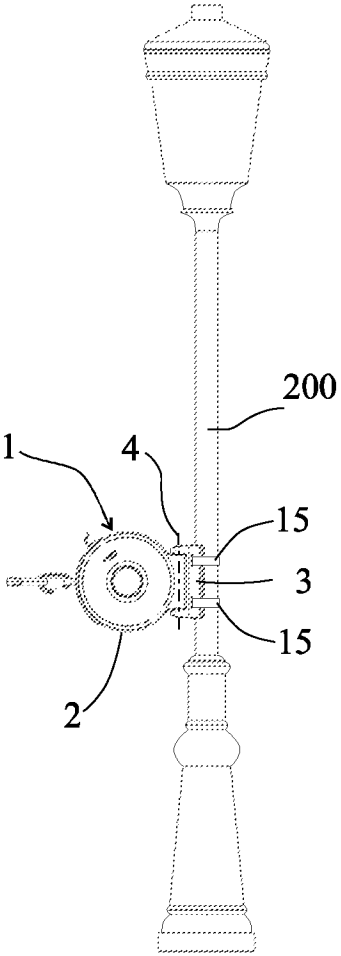
FIG. 2 shows a side view of the training apparatus of FIG. 1 which is fixed to a lamppost.

In the figures an embodiment of a physical training apparatus is shown. The apparatus as a whole is indicated by reference numeral 1. The training apparatus 1 is portable and can be attached to a support structure. In FIG. 2 is shown by way of example that the apparatus is attached to a lamppost 200.

It must be understood that the training apparatus 1 in the shown embodiment includes a support 3 with which it can typically be attached by tensioning bands 15 to a pole type of structure, such as the lamppost 200, but also trees etc. However, also other supports, adapted to attach the apparatus to another structure, e.g. door posts, walls and ceilings are conceivable and are considered to be comprised within the concept of the present invention.

The apparatus 1 comprises a housing 2, which can be coupled to the support 3 by a coupling, which will be described in more detail further below. The housing 2 can pivot with respect to the support 3, about a pivot axis 4 which in the example shown in FIGS. 1 and 2 extends in a vertical direction. However, the apparatus 1 can also be used in a mode in which the pivot axis is not vertical. In one possible practical mode the apparatus may for example be mounted such that the pivot axis 4 extends substantially horizontal.

Figure 4:
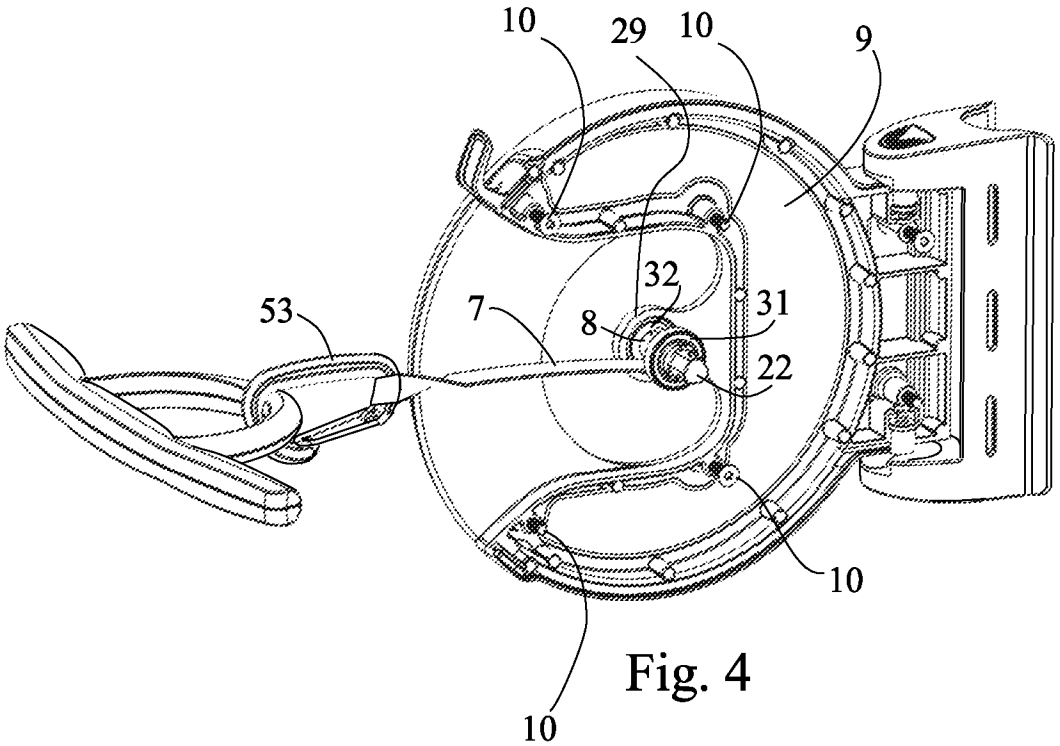
FIG. 4 shows an exploded view in perspective of the apparatus of FIG. 1 wherein a covering plate of the housing is removed.

In a practical embodiment the housing 2 comprises shells 9 formed from plastics material or aluminium. The shells 9 can be made by injection moulding. In FIG. 4 is shown a view in which one of the shells 9 is removed. The shells 9 are placed opposite each other and connected by screws 10.

The training apparatus 1 in general includes a flywheel mechanism, which will be explained in more detail further below, and a pull band 7 that is wound around a spindle 8 of the flywheel mechanism (cf. FIG. 3). The pull band 7 has on its free end a handle 5, which in the embodiment shown in the figures is connected to the pull band 7 by a carabiner 53. During exercise the user can pull the band 7 via the handgrip 5, and set the flywheel mechanism in motion. The housing 2 has a guiding passage 6 through which the band 7 extends towards the spindle (see FIGS. 1 and 3). Ideally the tensioned band 7 and the guiding passage towards the spindle 8 are aligned. However, since the housing 2 can pivot with respect to the support 3 around the pivot axis 4, the housing 2 can adjust its own position and swivel to an orientation that the housing 2 and the band 7 are aligned when the user pulls the band 7 a bit sideways.

Figure 10:
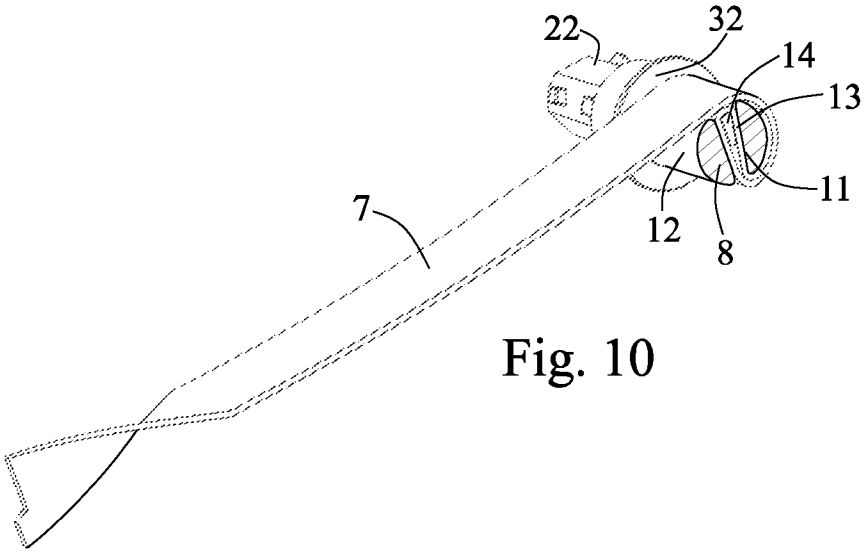
FIG. 10 illustrates in a view in perspective the attachment of a pull band to the spindle of the apparatus of FIG. 1.

The pull band 7 is attached to the spindle 8 as is shown in FIG. 10. The spindle 8, which is shown in a cross section, is formed having a substantially cylindrical outer surface 12, which constitutes the wind/unwind portion of the spindle on which the pull element 7 can be wound unwound. The axial ends of the wind/unwind portion 12 of the spindle 8 are delimited by radial collars 32 integrally formed on the spindle. In a preferred embodiment the diameter of the cylindrical surface 12 is 15 mm, but this may vary in practise between 10 mm and 16 mm.

The spindle 8 is preferably injection moulded in aluminium. However, also other materials and processes are conceivable to manufacture the spindle.

At the wind/unwind portion a gap 11 is generally extending diametrically through the spindle 8. The gap 11 is tapering from a wide end to a narrow end. At the end of the pull band 7 a loop 13 is formed. To assemble the pull band 7 and the spindle 8 the loop 13 is folded such that it becomes a relatively flat state in which it can be passed through the gap 11 from the narrow end to the wide end of the gap 11. When the loop 13 during the assembly extends beyond the outer surface at the wide end of the gap 11, a key body 14 can be inserted in the loop 13. When the band 7 is pulled again the key body 14, which preferably has a tapering shape corresponding to the narrowing shape of the gap 11 is pulled in the gap and secures the loop 13 in the gap of the spindle 8.

To release the pull band 7 from the spindle 8, for example in the event that a user wishes to replace a worn pull band 7 with a new one, he can lever the loop 13 and the key body 14 out of the gap 11 through the wide end of the gap 11 by a screw driver or another suitable tool, after which the key body 14 can be removed and the loop 13 can be pulled out from the narrow end of the gap 11.

Figure 11:
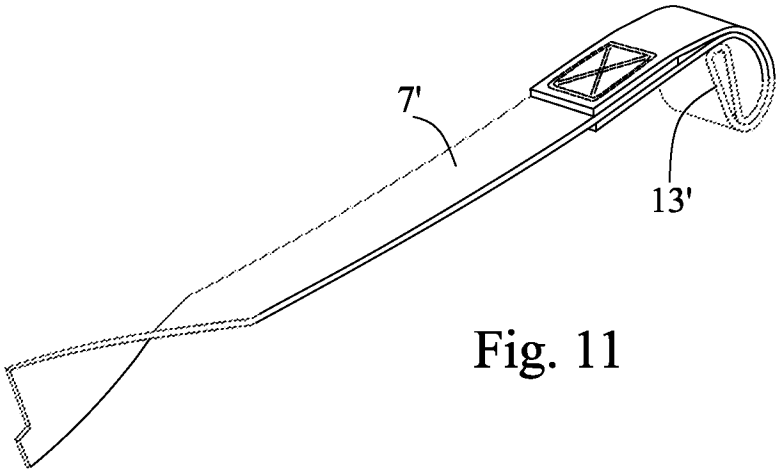
FIG. 11 shows in a view in perspective another embodiment of the pull band for an apparatus of FIG. 1.

The loop may be an integrally formed portion of the pull band 7 as is shown in FIG. 10. It is also possible to provide a loop 13' at the end of the pull band 7' which is made of a separate band, which is then attached, e.g. stitched to the pull band 7, as is shown in FIG. 11. This has the advantage that for the band for the loop 13' another material can be used than for the pull band 7'. One option is to make the loop 13' as shown in FIG. 11 from an elastic band, which provides the advantage that when the pull band 7 is completely unreeled, the loop 13' deforms elastically such that the shock at the end of the stroke of the pull band 7' gets absorbed by the elastic loop 13' and no peak load is transferred via the band 7' to the user holding the handle 5.

Figure 12A:
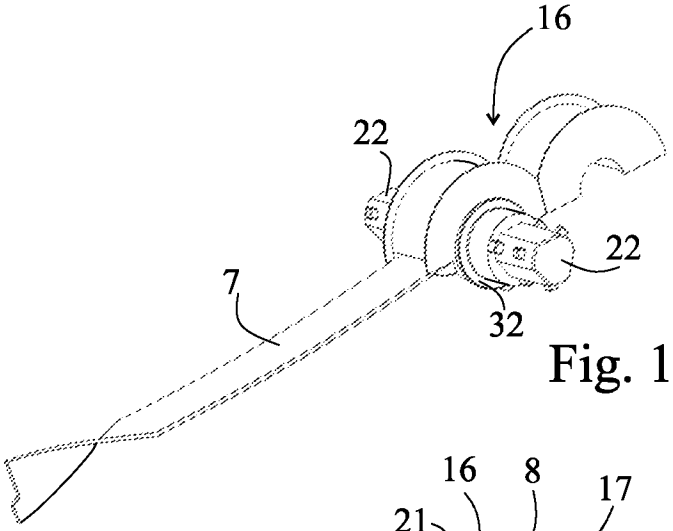
FIG. 12*a* illustrates the arrangement of a spindle adapter on the spindle.
Figure 12B:
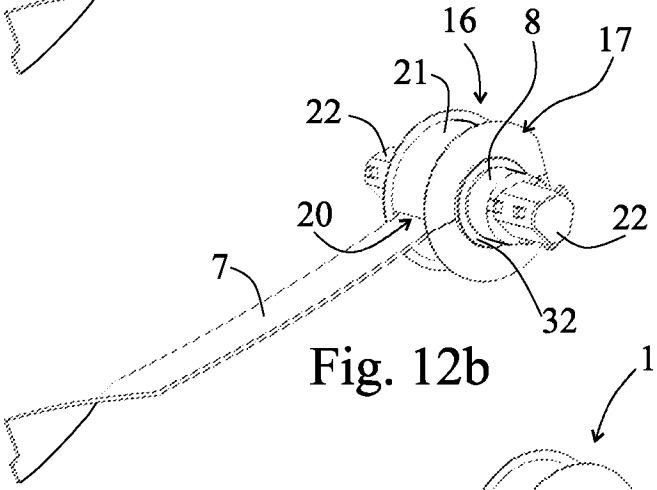
FIG. 12*b* shows the spindle with the spindle adapter mounted on the spindle.
Figure 12C:
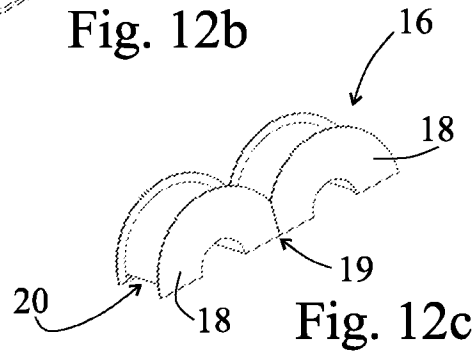
FIG. 12*c* shows the spindle adapter as such in a pre-mounting state.

In FIGS. 12*a*-12*c* is shown a spindle adapter 16 which can be placed on the spindle 8 to increase the diameter of the surface on which the pull band 7 is wound. The spindle adapter 16 comprises a reel 17 which is arranged around the spindle 8. The reel 17 includes two reel halves 18 that are placed around the spindle 8 and then interconnected such that it can be retrofitted to an existing apparatus 1 without having to disassemble the spindle 8 from the housing 2. In the embodiment shown in FIGS. 12*a*-12*c* the reel halves 18 are connected on one end by a hinge 19. In a particular embodiment shown the reel 17 can be made from plastic by means of injection moulding, and the hinge 19 is formed integrally on the reel halves 18 as a living hinge or film hinge. Opposite the hinge 19 a recess 20 is formed in the reel surface 21 on which the pull band 7 is to be reeled. In the closed state of the reel 17 as is shown in FIG. 12*b* the recess 20 forms a passage for the pull band 7, which is secured to the spindle 8 in the way as is shown in FIG. 10 or 11.

Figure 5:
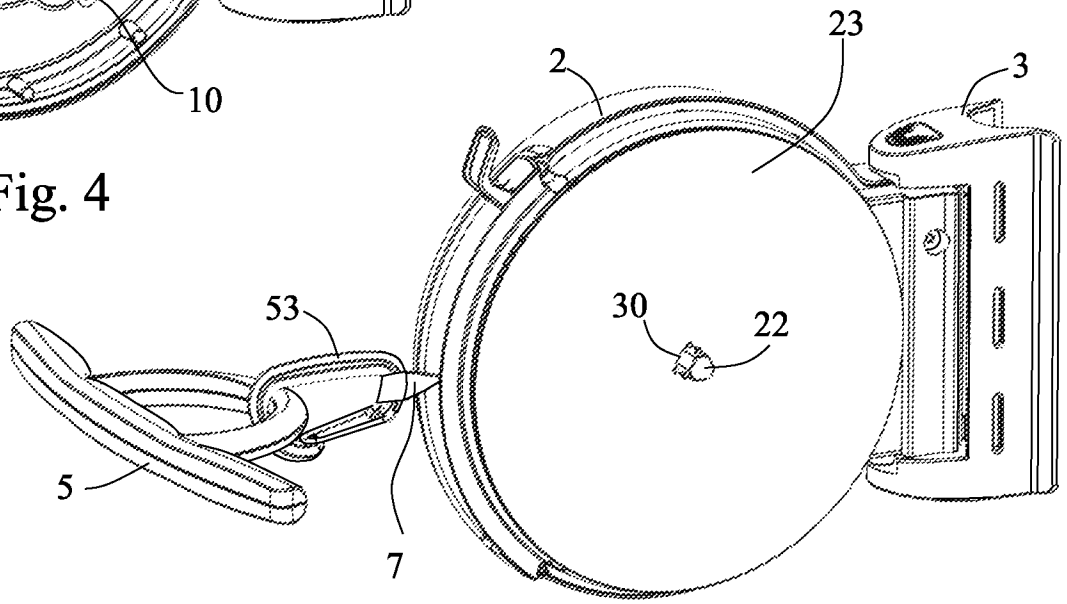
FIG. 5 shows a similar view as FIG. 4, but with a flywheel mounted on the spindle end portion.

The spindle 8 includes a spindle end portion 22. In the embodiment shown in the figures the spindle 8 has two spindle end portions 22. A flywheel 23 can be mounted on each one of the spindle end portions 22 as can be seen in FIG. 5. In general the apparatus thus comprises two of the flywheels 23, each one mounted on one of the respective spindle end portions 22. The flywheels 23 are fastened to the respective spindle end portions 22 by respective fastening knobs 34 as will be explained further below.

Figure 6B:
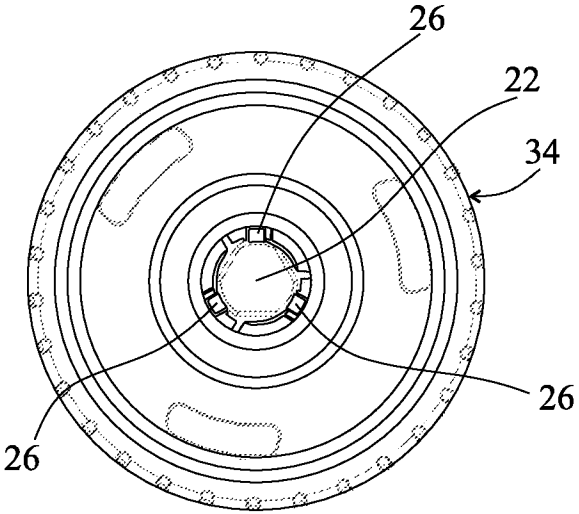
FIG. 6*b* shows an elevational view of the fastening knob and the spindle of FIG. 6*a*.
Figure 6A:
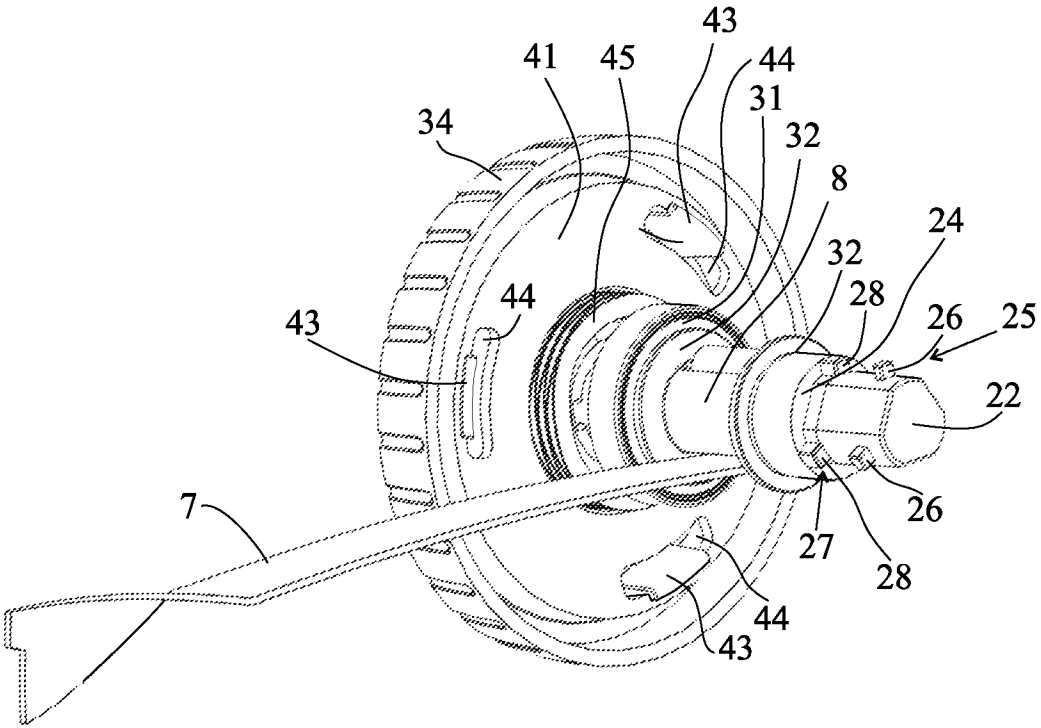
FIG. 6*a* shows a view in perspective of a detail of a spindle and a fastening knob of the apparatus of FIG. 1.

The flywheel 23 is positioned against a stop 24 located on the spindle 8, which stop is visible in FIG. 6*a*. The spindle end portion 22 has is a possible embodiment substantially a polygonal cross section. In FIG. 6*a* is visible that it has a hexagonal cross section. The flywheel 23 has a central aperture 30 with a corresponding shape which fits over the spindle end portion 22.

Figure 13B:
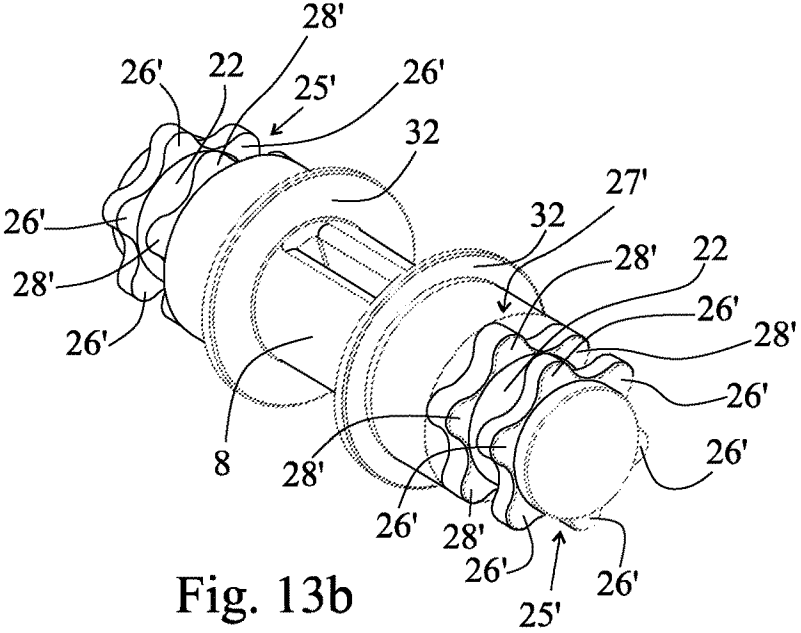
FIG. 13*b* shows in a view in perspective the spindle having the alternative end portion shown in FIG. 13*a*.
Figure 13A:
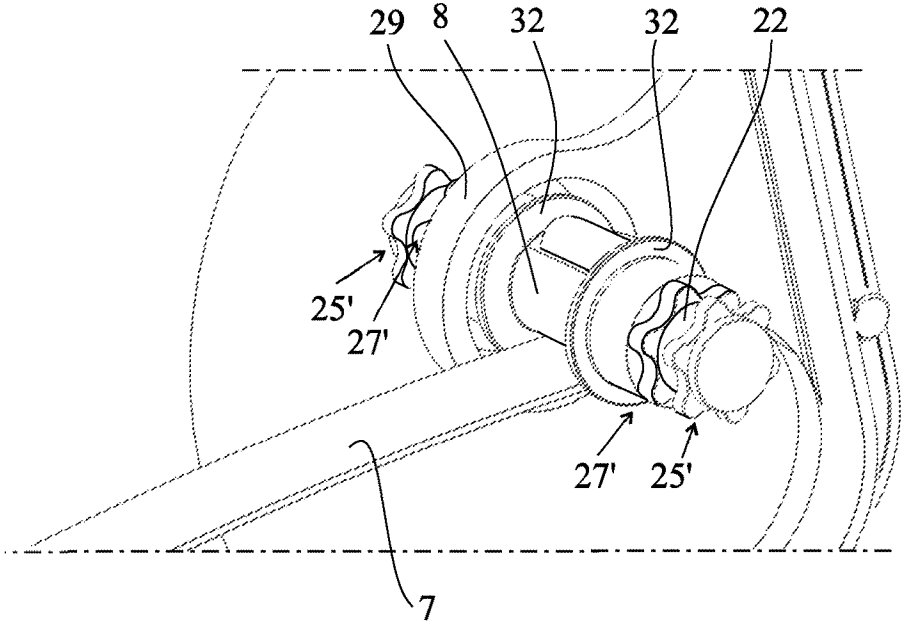
FIG. 13*a* shows a partly exploded view of a part of an embodiment of the training apparatus according to the invention including a spindle with an alternative end portion.

Also other shapes suitable for coupling the spindle end portion 22 to the flywheel 23 in a form-fitting manner in the rotational direction are possible such as for example a shape as is shown in FIGS. 13A and 13B. Therein the first set 25' of projections 26' and the second set 27' of projections have a sort of lobed shape. The flywheel has a similar lobed shaped central opening, typical for torx shapes known from screw heads, which fits over the sets 25' and 27' of projections.

Figure 9:
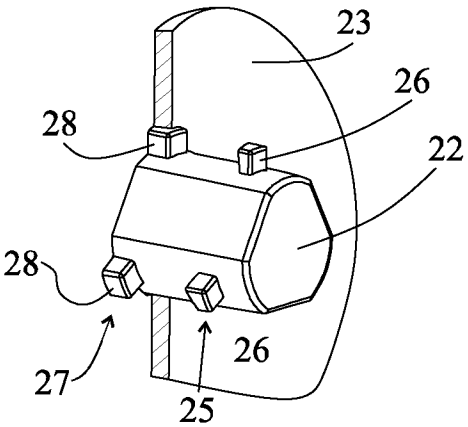
FIG. 9 shows a detail of the spindle extending through a flywheel.

A first set 25 of one or more radial projections 26, in the example three projections (see for example FIG. 6*b*), are formed on the spindle end portion 22. The central aperture 30 of the flywheel 23 has one or more recesses in its outer contour corresponding with the pattern of the one or more radial projections 26 of the first set 25 such that the flywheel 23 can be moved beyond the one or more radial projections 26 and against the stop 24, which situation is visible in FIG. 5 and FIG. 9.

A second set 27 of one or more radial projections 28 are formed on the spindle end portion 22. The second set 27 of radial projections 28 adjoins the stop 24 as is visible in FIG. 6*a*. When the flywheel 23 is arranged against the stop 24, the projections 28 of the second set 27 are received in the recesses of the aperture 30 of the flywheel 23 as is visible in FIGS. 5 and 9. The second set 27 of projections 28 provides a form fit and thus an interlocking between the flywheel 23 and the spindle end portion 22 in the rotational direction, because the projections 28 of the second set 27 are received in the recesses of the aperture 30 of the flywheel 23.

The spindle 8 is supported rotatably in the housing 2 by means of bearings 31. The bearings 31 conveniently are roller bearings. The spindle 8 has a pair of radial collars 32 formed on it. The respective collars 32 constitute a stop for the respective bearings 31 on the spindle 8. The collars 32 delimit between them the wind/unwind portion of the spindle 8. On the opposite side the bearings 31 are locked in by a bearing support portion 29 of the housing 2. The respective bearing support portions 29 of the housing 2 are in the embodiment shown in the figures an integral part of the shells 9 of the housing 2.

A fastening knob 34 is releasably coupled to the spindle end portion 22 to lock the flywheel 23 on the spindle end portion 22. The fastening knob 34 is adapted to engage the flywheel 23 and force it against the stop 24 located on the spindle 8. The fastening knob 34 has an engagement opening 35 centrally in the knob 34. The engagement opening 35 is adapted to receive the spindle end portion 22.

In the specific embodiments shown in the figures the fastening knob 34 comprises an interior body 41, including the engagement opening 35 in the centre, and an exterior cap 39 which encloses the interior body 41. The exterior cap 39 covers, in a mounted state, the spindle end portion 22 of the spindle 8. The exterior cap 39 is coupled to the interior body 41 by snap fingers 43 snapping behind the edge of coupling openings 44 in the interior body 41.

Figure 7B:
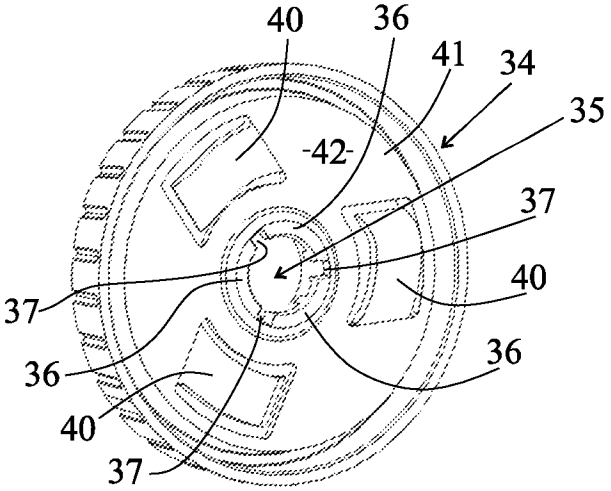
FIG. 7*b* shows a view in perspective from another side of the fastening knob of FIG. 7*a*.
Figure 6C:
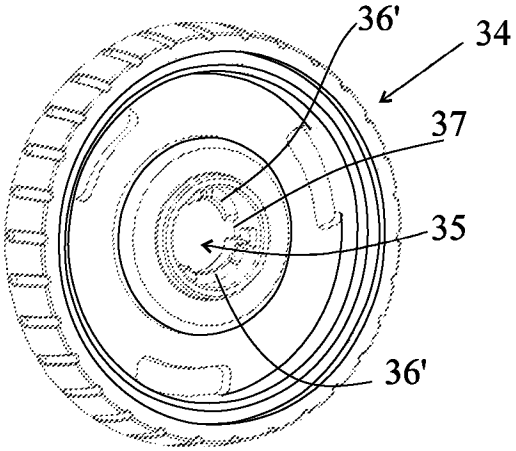
FIG. 6*c* shows a view in perspective of one side of the fastening knob of FIG. 6*a*.
Figure 7A:
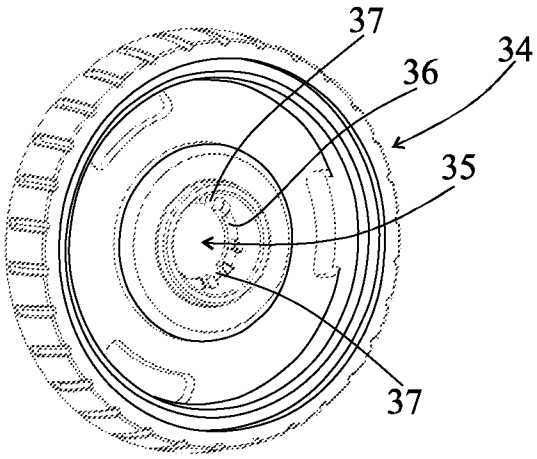
FIG. 7*a* shows a view in perspective from one side of another embodiment of a fastening knob.

As can be seen in FIGS. 7*a* and 7*b* in one embodiment the engagement opening 35 of the fastening knob 34 is defined by a radially inwardly extending flange 36 having one or more recesses 37 such that the recesses 37 of the flange 36 can be aligned with the radial projections 26 of the spindle end portion 22. When the spindle end portion 22 is inserted in the engagement opening 35 and when the projections 26 are moved beyond the flange 36, the recesses 37 can be misaligned with the radial projections 26 of the first set 25 by rotation of the knob 34 relative to the spindle end portion 22. Thereby a sort of a bayonet catch is formed. The flange 36 has a rear side having raised formations 38. In use, when the spindle end portion 22 is moved through the receiving aperture 35 of the knob 34, the first set 25 of projections 26 on the spindle end portion 22 move beyond a height of the raised formations 38 and when the recesses 37 are misaligned with the projections 26, the raised formations 38 move beyond the protrusions. Thus, when the knob is released by the user, projections 26 behind the raised portions 38 and the latter form a retaining stop for the projections 26.

The fastening knob 34 includes a spring element which resiliently forces the flywheel 23 against the stop 24. In FIG. 7*b* is visible that in one embodiment the spring element is formed by an inner portion of the interior body 41 having integrally formed resilient tongues 40 extending from an inside surface 42 of the body 41. The interior body 41 may conveniently be made of a plastics material such as POM by means of injection moulding and the tongues 40 may be formed in one piece therewith. However the tongues may also be separate pieces, e.g. of plastic or metal which are assembled with the body interior body 41. The interior body 41 may also be a metal piece, for example, while the exterior cap 39 is made of plastic, or also metal.

Figure 6D:
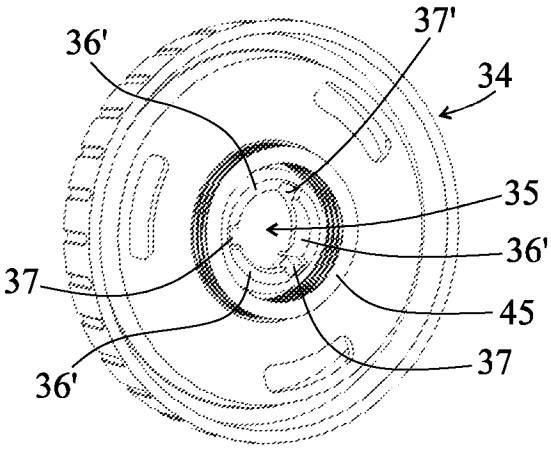
FIG. 6*d* shows a view in perspective of another side of the fastening knob of FIG. 6*a*.

Another embodiment is shown in FIGS. 6*a* and 6*d*. In this embodiment is made the spring element is a multiwave spring 45 that is assembled with the interior body 41. Multiwave springs 45 are known per se and have the advantage of providing a constant force independent of the compression of the spring.

The spring element 40, 45 forces the projections 26 of the first set 25 into engagement with the flange 36. The bayonet catch is a convenient coupling type to provide a quick coupling by a consecutive translation and rotation of the fastening knob 34 on the spindle end portion 22, and a quick release by a rotation and translation of the knob 34 relative to the spindle 8. Variations in the thickness of the flywheel 23 are absorbed by the spring elements 40 or 45.

Figure 6E:
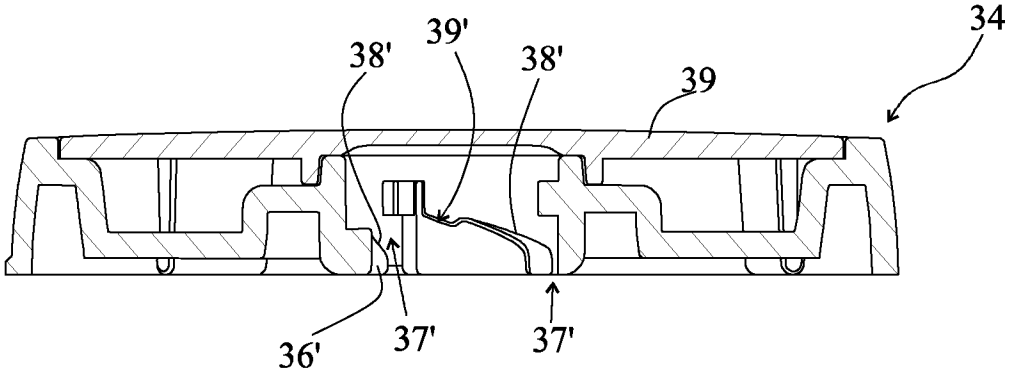
FIG. 6*e* shows a cross sectional view of the fastening knob of FIGS. 6*c* and 6*d*.

Another fastening structure for securing the knob 34 on the spindle 8 may be like is shown in FIGS. 6*b*-6*e*. In this embodiment the flange 36' has a pitch such that a sort of screw thread is formed. The projections 26 can be inserted through recesses 37', and then the knob 34 can be rotated, such that the knob 34 is tightened against the flywheel 23 by the projections 26 sliding along the flange 36' having a pitched surface 38'. In FIG. 6*e* can be best seen that at an end of the pitched surface 38' a recess 39' is formed in which the projection 26 can snap in. The snap connection fixes the knob with respect to the spindle such that the spindle can be rotated by rotating the knob to wind or unwind the pull band 7 on or of the spindle 8. The snap action is however such that when the rotation of the flywheel 23 or the spindle 8 is blocked the snap connection between projection 26 and recess 39' can be released for removing the knob 34 of the spindle end portion 22.

Figure 1:
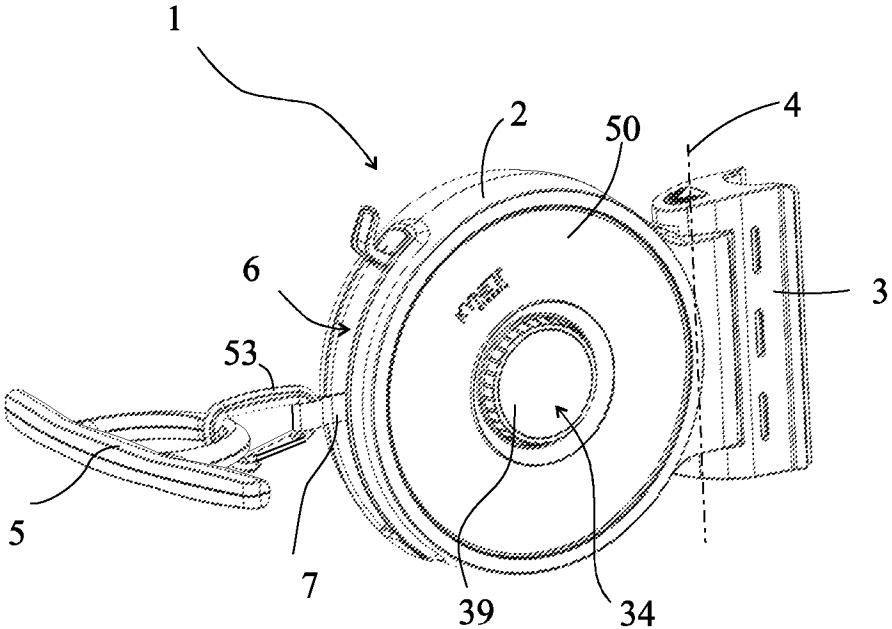
FIG. 1 shows a view in perspective of a preferred embodiment of the physical training apparatus according to the invention.
Figure 3:
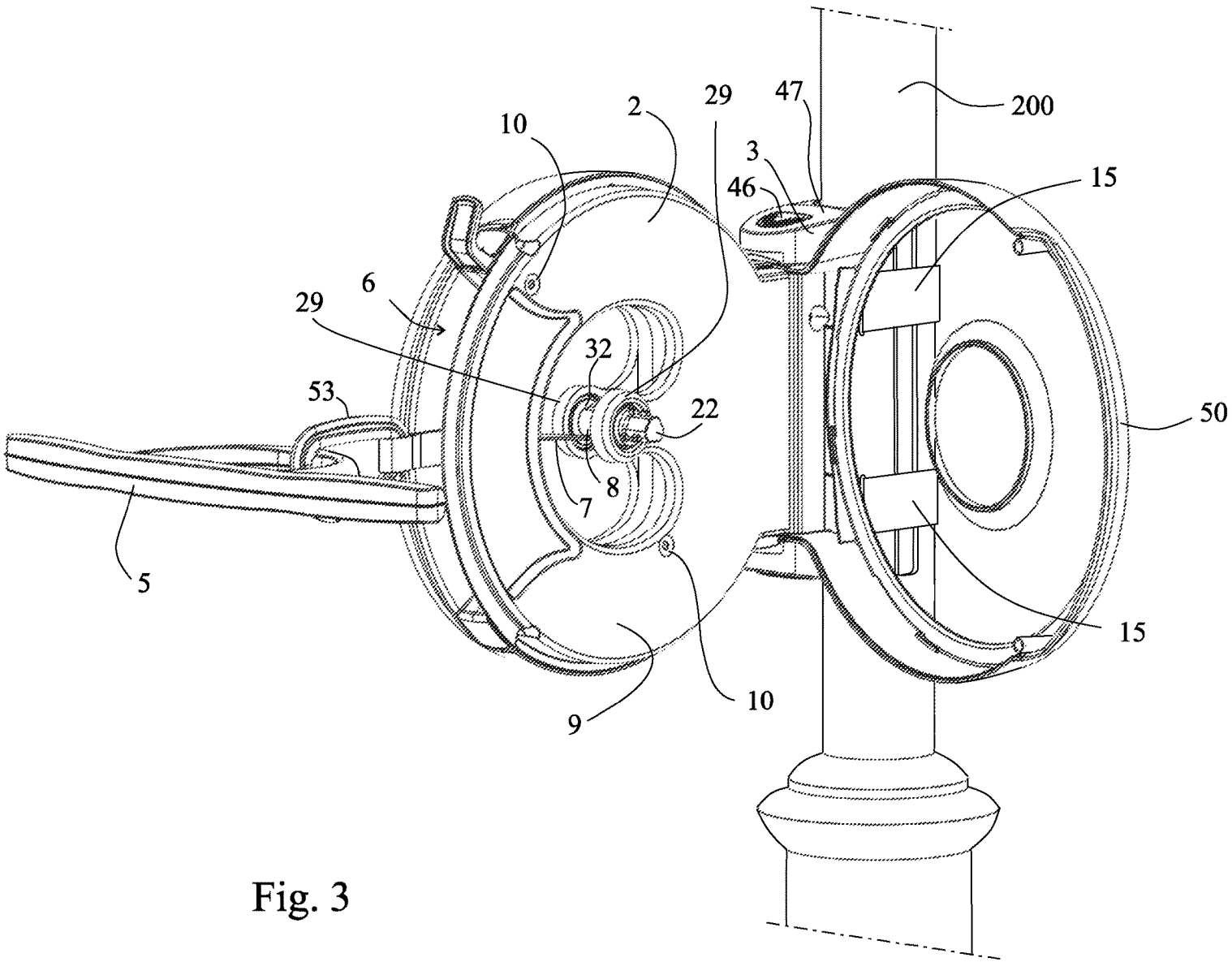
FIG. 3 shows a view in perspective of the training apparatus of FIG. 1, wherein the housing is opened and a flywheel is removed.

The housing 2 has on either of the lateral sides a covering lid 50, which is shown in FIG. 1 where it is in a closed state, and in FIG. 3 where it is in an open state. The covering lid 50 is in the embodiment shown, coupled to the remainder of the housing 2 by means of a hinging structure. Preferably the cover 50 is made of a transparent plastic material. The covering lid 50 can be opened as is shown in FIG. 3 to exchange the flywheel 23. It is noted that in FIG. 3 there is no flywheel 23 mounted yet on the spindle end portion 22.

As mentioned in the above, the housing 2 is releasably coupled to the support 3, preferably by a quick release coupling. An example of such a quick release coupling is illustrated in FIG. 8.

Figure 8:
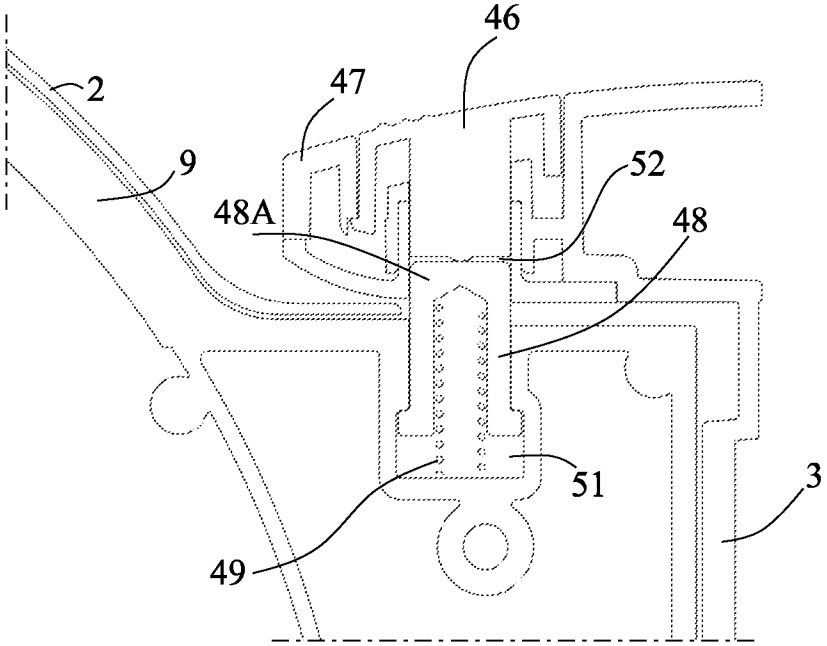
FIG. 8 shows a cross section of a quick release mechanism of the apparatus of FIG. 1.

The quick release coupling shown in FIG. 8 comprises a sliding locking body 48 which is partly received in and guided in an accommodation space 51 formed in the housing 2. A biasing spring 49 is provided to force the locking body out of the accommodation space 51, such that a free end 48A can extend into a locking space 52 in the support 3 and thereby interlock the support 3 and the housing 2. The support 3 is provided with a release button 46, in this embodiment on an upper side 47 of the support 3. The release button 46 extends into the locking space 52 and abuts the free end 48A of the locking body 48. When the release button 46 is pushed in, it pushes the locking body 48 into the accommodation space 51 against the biasing force of the spring 49. When the locking body 48 is entirely pushed out of the locking space 52, the housing can be detached from the support 3.

Thus the housing 2 can be decoupled from the fixed world, so as to carry it to another location. Also for exchanging the flywheel 23 it might be convenient to remove the housing 2 from the fixed support 3. The locking body 48 is preferably also functioning as a pivot pin defining the pivot axis 4. On the underside of the support 3 a similar release mechanism may be arranged.

In use the user can attach the support 3 to a pole 200 or other support by the tensioning bands 15. Then the housing 2 can be coupled to the support 3, either with or without the flywheels 23 mounted to the spindle 8. If the flywheels 23 are not yet mounted, a suitable set of flywheels can be selected by the user for performing a certain exercise. The selection can for example be made between different flywheels 23 having different thicknesses and/or different weights. Via the quick release knobs 34 the flywheels 23 can be quickly mounted or replaced by the user before a new exercise is started.

In case the pull band 7 is not yet fully wound on the spindle or spindle adapter, before use of the apparatus 1, the knob 34 may be conveniently used to turn the spindle 8 to wind the band 7 on the spindle 8 or on the spindle adapter 17.

During exercise the user grips the handle 5 and pulls the pull band 7 out of the slot 6 of the housing 2. The spindle 8 and the flywheels 23 are thereby set in rotation. When the pull band 7 is fully unwound or unreeled, the flywheel mechanism remains rotating due to the inertia of the flywheels 23, thereby winding the pull band 7 on the wind/unwind portion of the spindle 8 or the spindle adapter 17 again. During this return stroke the user then experiences a pull force which he/she has to brake by using muscle force. At the end of the return stroke the rotation is zero for one instant and then is reversed in direction when the user pulls the pull band 7 with the handle 5 again. This cycle can be repeated as long as desired. Variations in the physical exercise can be made by varying the flywheels 23.

According to the invention, and the possible embodiments according to the invention shown in the figures, a compact physical training apparatus is provided, which still allows a great range in exercises in view of intensity, speed, forces etc.

The invention claimed is:

1. A physical training apparatus comprising:

a housing;

a flywheel mechanism accommodated in the housing, said flywheel mechanism including a spindle, at least one flywheel mounted on the spindle and bearings to support the spindle in the housing;

a windable pull element which is arranged to be wound up the spindle and unwound from the spindle;

a handgrip attached to the pull element;

wherein the spindle includes a spindle end portion, wherein the flywheel is exchangeably mounted on the spindle end portion against a stop located on the spindle, and wherein a fastening knob is releasably coupled to the spindle end portion and adapted to engage the flywheel and force the flywheel against the stop located on the spindle;

wherein the fastening knob includes an associated spring element which resiliently forces the flywheel against the stop.

2. The physical training apparatus according to claim 1, wherein the spring element is a multiwave spring.

3. The physical training apparatus according to claim 2, wherein the spring element is integrally formed with a part of the fastening knob.

4. The physical training apparatus according to claim 1, wherein the spindle has two opposite of said spindle end portions and wherein the apparatus comprises two of said flywheels, each one mounted on one of the respective spindle end portions, and furthermore comprises two of said fastening knobs, each one fastening one of the flywheels.

5. The physical training apparatus according to claim 1, furthermore comprising a support adapted to be fixed to a stationary structure, wherein the housing is pivotably connected to the support, and wherein the pivot axis extends perpendicular to the axis of the spindle.

6. The physical training apparatus according to claim 5, wherein the housing is releasably coupled to the support.

7. The physical training apparatus according to claim 1, wherein the windable pull element has an end which is releasably connected to the spindle.

8. The physical training apparatus according to claim 1, wherein the spindle has a wind/unwind portion adapted to receive a pull element to be wound/unwound thereon, wherein said wind/unwind portion of the spindle has an outer diameter of 10-16 mm.

9. The physical training apparatus according to claim 1, wherein the spindle is made of aluminum.

10. A physical training apparatus comprising:

a housing;

a flywheel mechanism accommodated in the housing, said flywheel mechanism including a spindle, at least one flywheel mounted on the spindle and bearings to support the spindle in the housing;

a windable pull element which is arranged to be wound up the spindle and unwound from the spindle;

a handgrip attached to the pull element;

wherein the spindle includes a spindle end portion, wherein the flywheel is exchangeably mounted on the spindle end portion against a stop located on the spindle, and wherein a fastening knob is releasably coupled to the spindle end portion and adapted to engage the flywheel and force the flywheel against the stop located on the spindle;

wherein the spindle end portion has substantially a polygonal cross section, and wherein the flywheel has a central aperture with a corresponding shape which fits over the spindle end portion.

11. The physical training apparatus according to claim 10, wherein the fastening knob has an engagement opening wherein said engagement opening is adapted to receive the spindle end portion.

12. A physical training apparatus comprising:

a housing;

a flywheel mechanism accommodated in the housing, said flywheel mechanism including a spindle, at least one flywheel mounted on the spindle and bearings to support the spindle in the housing;

a windable pull element which is arranged to be wound up the spindle and unwound from the spindle;

a handgrip attached to the pull element;

wherein the spindle includes a spindle end portion, wherein the flywheel is exchangeably mounted on the spindle end portion against a stop located on the spindle, and wherein a fastening knob is releasably coupled to the spindle end portion and adapted to engage the flywheel and force the flywheel against the stop located on the spindle;

wherein a first set of one or more radial projections are formed on the spindle end portion, wherein the central aperture of the flywheel has one or more recesses in its outer contour corresponding with the pattern of the one or more radial projections of the first set such that the flywheel can be moved beyond the one or more radial projections, and wherein the engagement opening of the fastening knob is defined by a radially inwardly extending flange having one or more recesses such that the recesses of the flange can be aligned with the radial projections and when the spindle end portion is inserted in the engagement opening and when the projections are moved beyond the flange, the recesses of the flange can be misaligned with the radial projections of the first set by rotation of the knob relative to the spindle end portion so as to form a bayonet catch wherein the spring element forces the projection(s) of the first set of one or more radial projections into engagement with the flange.

13. The physical training apparatus according to claim 12, wherein the flange has a rear side having raised formations, wherein in use when the spindle end portion is moved through the engagement opening of the knob, the first set of projections on the spindle end portion are moved beyond a height of the raised formations and when the recesses are misaligned with said projections, the raised formations are moved beyond the projections of the first set, such that the raised formations form a retaining stop.

14. The physical training apparatus according to claim 12, wherein the flange has at least one rear surface portion with a pitch, whereby upon rotation of the knob relative to the spindle end portion, at least one of the projections slide relative to the pitched surface and the knob is tightened on the spindle end portion.

15. The physical training apparatus according to claim 12, wherein the fastening knob comprises an interior body, including the engagement opening, and an exterior cap which covers, in a mounted state, the interior body, at least partly, and the spindle end portion.

16. The physical training apparatus according to claim 12, wherein a second set of one or more radial projections is formed on the spindle end portion, wherein the second set of one or more radial projections adjoins the stop, such that when the flywheel is arranged against the stop, the projection(s) of the second set are received in the recess(es) of the aperture of the flywheel.

17. A physical training apparatus comprising:

a housing;

a flywheel mechanism accommodated in the housing, said flywheel mechanism including a spindle, at least one flywheel mounted on the spindle and bearings to support the spindle in the housing;

a windable pull element which is arranged to be wound up the spindle and unwound from the spindle;

a handgrip attached to the pull element;

wherein the spindle includes a spindle end portion, wherein the flywheel is exchangeably mounted on the spindle end portion against a stop located on the spindle, and wherein a fastening knob is releasably coupled to the spindle end portion and adapted to engage the flywheel and force the flywheel against the stop located on the spindle; and wherein the housing comprises at least on one lateral side, a covering lid, which is removable from the housing to exchange the flywheel.

18. A physical training apparatus comprising:

a housing;

a flywheel mechanism accommodated in the housing, said flywheel mechanism including a spindle, at least one flywheel mounted on the spindle and bearings to support the spindle in the housing;

a windable pull element which is arranged to be wound up the spindle and unwound from the spindle;

a handgrip attached to the pull element;

wherein the spindle includes a spindle end portion, wherein the flywheel is exchangeably mounted on the spindle end portion against a stop located on the spindle, and wherein a fastening knob is releasably coupled to the spindle end portion and adapted to engage the flywheel and force the flywheel against the stop located on the spindle; and a spindle adapter, which includes a reel to be arranged around a wind/unwind portion of the spindle where the windable pull element is wound and unwound during use, wherein the reel has an outer surface on which the windable pull element is wound, and which has an outer diameter which is larger than the diameter of the wind/unwind portion of the spindle.

* * * * *